US009905162B2

(12) United States Patent
Yoo

(10) Patent No.: US 9,905,162 B2
(45) Date of Patent: Feb. 27, 2018

(54) DEGRADATION COMPENSATOR OF ORGANIC LIGHT EMITTING DIODE DISPLAY DEVICE

(71) Applicant: Samsung Display Co., LTD., Yongin-si, Gyeonggi-Do (KR)

(72) Inventor: Hyunseuk Yoo, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 128 days.

(21) Appl. No.: 15/092,155

(22) Filed: Apr. 6, 2016

(65) Prior Publication Data

US 2016/0372033 A1 Dec. 22, 2016

(30) Foreign Application Priority Data

Jun. 22, 2015 (KR) ..... 10-2015-0088541

(51) Int. Cl.

| | |
|---|---|
| ***G09G 3/30*** | (2006.01) |
| ***G09G 3/3225*** | (2016.01) |
| ***G09G 3/20*** | (2006.01) |
| ***G09G 5/22*** | (2006.01) |
| ***G09G 3/3233*** | (2016.01) |

(52) U.S. Cl.

CPC ..... *G09G 3/3225* (2013.01); *G09G 3/2003* (2013.01); *G09G 3/3233* (2013.01); *G09G 5/22* (2013.01); *G09G 2300/043* (2013.01); *G09G 2300/0857* (2013.01); *G09G 2320/0257* (2013.01); *G09G 2320/046* (2013.01); *G09G 2340/16* (2013.01); *G09G 2360/127* (2013.01)

(58) Field of Classification Search

CPC ..... G09G 2320/043–2320/048

See application file for complete search history.

(56) References Cited

U.S. PATENT DOCUMENTS

| | | | | |
|---|---|---|---|---|
| 7,675,492 | B2 | 3/2010 | Park et al. | |
| 2003/0071804 | A1* | 4/2003 | Yamazaki | G09G 3/3233 345/204 |

(Continued)

FOREIGN PATENT DOCUMENTS

| | | | |
|---|---|---|---|
| KR | 1020120094736 | A | 8/2012 |
| KR | 1020140078500 | A | 6/2014 |

(Continued)

*Primary Examiner* — Ryan D McCulley

(74) *Attorney, Agent, or Firm* — Cantor Colburn LLP

(57) ABSTRACT

Degradation compensator includes a compressor which generates a block-level compression stress matrix ("BCSM") representing a degradation level of a block included in a frame by R, G, and B input signals of the block, an updater update a frame-level accumulated compression stress matrix ("FACSM") by adding the BCSM, an error corrector which executes error-correction encoding to elements of a block-level accumulated compression stress matrix ("BACSM") included in the FACSM, writes encoded elements as a storage data of a non-volatile memory device when a power supply is stopped, executes error-correction decoding to the storage data and writes the decoded storage data as the FACSM of the volatile memory when the power supply is started, a restorer which generates a block-level accumulated stress matrix ("BASM"), and an internal compensator which generates compensated R, G, and B output signals.

16 Claims, 19 Drawing Sheets

(56) References Cited

U.S. PATENT DOCUMENTS

| | | | | |
|---|---|---|---|---|
| 2003/0214521 | A1* | 11/2003 | Osame | G09G 3/3216 345/690 |
| 2010/0007656 | A1* | 1/2010 | Okamoto | G09G 3/3233 345/214 |
| 2014/0111567 | A1* | 4/2014 | Nathan | G09G 3/3233 345/694 |
| 2014/0292342 | A1* | 10/2014 | Chaji | G09G 3/006 324/414 |
| 2015/0062202 | A1* | 3/2015 | Lu | H03M 7/3059 345/691 |
| 2015/0194096 | A1* | 7/2015 | Chung | G09G 3/3275 345/78 |
| 2015/0243201 | A1* | 8/2015 | Chung | G09G 3/3225 345/690 |
| 2016/0140895 | A1* | 5/2016 | Park | G09G 3/3208 345/690 |

FOREIGN PATENT DOCUMENTS

| | | |
|---|---|---|
| KR | 1020140078502 A | 6/2014 |
| KR | 1020150082807 | 7/2015 |
| KR | 1020150101507 | 9/2015 |

* cited by examiner

DEGRADATION COMPENSATOR OF ORGANIC LIGHT EMITTING DIODE DISPLAY DEVICE

This application claims priority to Korean Patent Applications No. 10-2015-0088541, filed on Jun. 22, 2015, and all the benefits accruing therefrom under 35 U.S.C. § 119, the content of which in its entirety is herein incorporated by reference.

BACKGROUND

1. Field

Exemplary embodiments relate generally to display device. More particularly, embodiments of the invention relate to degradation compensator of organic light emitting diode display device.

2. Description of the Related Art

Since an organic light emitting diode ("OLED") display device displays an image using an OLED that generates light, the OLED display device doesn't need a light source (e.g., a backlight unit) unlike a liquid crystal display device ("LCD"). Thus, the OLED display device may be relatively thin and light. In addition, the OLED display device may have advantages of low power consumption, improved luminance, improved response speed, etc., compared to the LCD. Hence, the OLED display device is widely used as a display device included in an electronic device.

In a case of a pixel circuit which displays the same pattern consistently with high luminance in a display panel included in the OLED display device, e.g., a portion displaying a company logo such as "NBC" or "CBS", a mobility of the driving transistor is degraded because of strong and consistent current applied thereto. After degradation of the pixel circuit, image sticking occurs on the pixel circuit so that viewers may see the logo on another image that does not intend to display the logo.

The image sticking may be removed when a degradation level or stress applied to the display panel of the OLED display device is calculated accurately. For accurate calculation of the stress, stress accumulation values, which is in proportion to sum of luminance which each part of the display panel have emitted light with, may be stored as a stress matrix form. Because the stress matrix requires a very large sized storage, the stress matrix is linearly transformed, compressed, and accumulated.

SUMMARY

When errors occur on low-frequency component of an accumulated stress matrix and an organic light emitting diode ("OLED") display device compensates input signals according to the accumulated stress matrix having error, luminance of a predetermined blocks included in a frame may be distorted.

Exemplary embodiments provide degradation compensators reducing errors on stress matrix of display panel of the OLED display device, and preventing accumulation of errors when errors are detected on the stress matrix.

According to exemplary embodiments, a degradation compensator includes a compressor, a non-volatile memory device, an updater, an error corrector, a restorer, and an internal compensator. The compressor generates a block-level compression stress matrix ("BCSM") representing a degradation level of a block included in a frame by red (R), green (G), and blue (B) input signals of the block. The updater includes a volatile memory. The updater updates a FACSM by adding the BCSM to the FACSM. The FACSM is stored in the volatile memory. The FACSM represents an accumulated degradation level of the frame. The error corrector executes error-correction encoding to elements of a block-level accumulated compression stress matrix ("BACSM") included in the FACSM with different intensities and writes the encoded elements as a storage data of the non-volatile memory device when a power supply is stopped. The error corrector executes error-correction decoding to the storage data and writes the decoded storage data as the FACSM of the volatile memory when the power supply is started. The restorer generates a block-level accumulated stress matrix ("BASM") by restoring a BACSM corresponding to the block among the FACSM. The internal compensator generates compensated R, G, and B output signals corresponding to the block by adding the R, G, and B input signals and data compensation values generated based on the BASM.

In an exemplary embodiment, the elements may include at least one low-frequency element and at least one high-frequency element.

In an exemplary embodiment, an intensity of error-correction encoding applied to the at least one low-frequency element may be equal to or larger than an intensity of error-correction encoding applied to the at least one high-frequency element.

In an exemplary embodiment, the number of parity bits generated during error-correction encoding of the at least one low-frequency element may be equal to or larger than the number of parity bits generated during error-correction encoding of the at least one high-frequency element.

In an exemplary embodiment, an intensity of error-correction encoding applied to upper bits of the at least one low-frequency element may be equal to or larger than an intensity of error-correction encoding applied to lower bits of the at least one low-frequency element. An intensity of error-correction encoding applied to upper bits of the at least one high-frequency element may be equal to or larger than an intensity of error-correction encoding applied to lower bits of the at least one high-frequency element.

In an exemplary embodiment, the number of parity bits generated during error-correction encoding of upper bits of the at least one low-frequency element may be equal to or larger than the number of parity bits generated during error-correction encoding of lower bits of the at least one low-frequency element. The number of parity bits generated during error-correction encoding of upper bits of the at least one high-frequency element may be equal to or larger than the number of parity bits generated during error-correction encoding of lower bits of the at least one high-frequency element.

In an exemplary embodiment, the compressor may include a stress matrix generator, a transformer, and a selector. The stress matrix generator may generate a block-level stress matrix ("BSM") corresponding to the block based on the R, G, and B input signals. The transformer may generate a transformed stress matrix ("TSM") by applying linear transformation to the BSM. The selector may generate the BCSM by selecting a portion of the TSM.

In an exemplary embodiment, when the BSM is four by four (i.e., 4×4) matrix and the linear transformation is a discrete cosine transformation ("DCT"), the selector may generate the BCSM by selecting a (1, 1)-th element, a (1, 2)-th element, a (2, 1)-th element, and a (2, 2)-th element of the TSM, which are low-frequency elements of the TSM.

In an exemplary embodiment, when the BSM is 4×4 matrix and the linear transformation is a hadamard transformation, the selector may generate the BCSM by selecting a (1, 1)-th element, a (1, 3)-th element, a (3, 1)-th element, and a (3, 3)-th element of the TSM.

In an exemplary embodiment, the linear transformation may be a haar transformation.

According to exemplary embodiments, a degradation compensator includes a compressor, a non-volatile memory device, an updater, a cyclic redundancy checker, a restorer, and an internal compensator. The compressor generates a BCSM representing a degradation level of a block included a frame by R, G, and B input signals of the block. The updater includes a volatile memory. The updater updates a FACSM by adding the BCSM to the FACSM when an enable signal is activated. The FACSM is stored in the volatile memory. The FACSM represents an accumulated degradation level of the frame. The updater outputs a portion of elements of a BACSM included in the FACSM as a partial data signal sequentially when a power supply is stopped. The cyclic redundancy checker generates a cyclic redundancy check ("CRC") parity by executing cyclic redundancy check to the partial data signal and writes the CRC parity to the non-volatile memory device when the power supply is stopped. The restorer generates a BASM by restoring a BACSM corresponding to the block among the FACSM. The internal compensator generates compensated R, G, and B output signals corresponding to the block by adding the R, G, and B input signals and data compensation values generated based on the BASM. The updater reads the CRC parity and the FACSM from the non-volatile memory device when the power supply is started, and the updater activates or deactivates the enable signal by comparing the read CRC parity and a CRC parity which is re-generated from the read FACSM.

In an exemplary embodiment, the updater may activate the enable signal when the read CRC parity is the same as the re-generated CRC parity. The updater may deactivate the enable signal when the read CRC parity is different from the re-generated CRC parity.

In an exemplary embodiment, the CRC parity may include first through third CRC parity bits. The cyclic redundancy checker may include first and second exclusive OR ("XOR") gates, and first through third D flip-flops. A first input terminal of the first XOR gate may receive the partial data signal, a second input terminal of the first XOR gate may receive the third CRC parity bit, and an output terminal of the first XOR gate may output a first signal. A data input terminal of the first D flip-flop may receive the first signal, a clock input terminal of the first D flip-flop may receive a clock signal, and a data output terminal of the first D flip-flop may output the first CRC parity bit. A first input terminal of the second XOR gate may receive the first signal, a second input terminal of the second XOR gate may receive the first CRC parity bit, and the output terminal of the second XOR gate may output a second signal. A data input terminal of the second D flip-flop may receive the second signal, a clock input terminal of the second D flip-flop may receive the clock signal, and a data output terminal of the second D flip-flop may output the second CRC parity bit. A data input terminal of the third D flip-flop may receive the second CRC parity bit, a clock input terminal of the third D flip-flop may receive the clock signal, and a data output terminal of the third D flip-flop may output the third CRC parity bit.

According to exemplary embodiments, a degradation compensator includes a compressor, a non-volatile memory device, an updater, an error corrector, a cyclic redundancy checker, a restorer, and an internal compensator. The compressor generates a BCSM representing a degradation level of a block included in a frame by R, G, and B input signals of the block. The updater includes a volatile memory. The updater updates a FACSM by adding the BCSM to the FACSM when an enable signal is activated. The FACSM is stored in the volatile memory. The FACSM represents an accumulated degradation level of the frame. The updater outputs a portion of elements of a BACSM included in the FACSM as a partial data signal sequentially when a power supply is stopped. The error corrector executes error-correction encoding to the elements of the BACSM included in the FACSM with different intensities and writes the encoded elements as a storage data of the non-volatile memory device when the power supply is stopped. The error corrector executes error-correction decoding to the storage data and writes the decoded storage data as FACSM of the volatile memory when the power supply is started. The cyclic redundancy checker generates a CRC parity by executing cyclic redundancy check to the partial data signal and writes the CRC parity to the non-volatile memory device when the power supply is stopped. The restorer generates a BASM by restoring the BACSM corresponding to the block among the FACSM. The internal compensator generates compensated R, G, and B output signals corresponding to the block by adding the R, G, and B input signals and data compensation values generated based on the BASM. The updater reads the CRC parity from the non-volatile memory device when the power supply is started. The updater activates or deactivates the enable signal by comparing the read CRC parity and a CRC parity which is re-generated from the FACSM of the volatile memory written by the error corrector.

In an exemplary embodiment, the updater may activate the enable signal when the read CRC parity is the same as the re-generated CRC parity. The updater may deactivate the enable signal when the read CRC parity is different from the re-generated CRC parity.

In an exemplary embodiment, the error corrector may stop writing operation to the non-volatile memory device when differences between elements of a FACSM, which is re-read from the non-volatile memory device, and elements of the updated FACSM exceed a predetermined range when the power supply is stopped.

As describe above, the degradation compensator according to exemplary embodiments may reduce errors on stress matrix representing a degradation level of the display panel, and may improve output quality of the display device by preventing accumulation of errors when errors are detected on the stress matrix.

Therefore, a mobile device according to exemplary embodiments may include a flexible touch-screen having an external touch-screen region, an internal foldable touch-screen region, and a curved-surface touch-screen region that couples the external touch-screen region and the internal foldable touch-screen region. Thus, the mobile device may provide users with a user interface that selectively executes an application program on the external touch-screen region or the internal foldable touch-screen region by moving an icon corresponding to an executing application program to the curved-surface touch-screen region in response to a folding angle of the internal foldable touch-screen region when a folding operation of the internal foldable touch-screen region is performed (i.e., when the internal foldable touch-screen region is folded or unfolded).

In addition, a method of operating a mobile device according to exemplary embodiments, where the mobile device includes a flexible touch-screen having an external touch-screen region, an internal foldable touch-screen region, and a curved-surface touch-screen region that couples the external touch-screen region and the internal foldable touch-screen region, may provide users with a user interface that selectively executes an application program on the external touch-screen region or the internal foldable touch-screen region by moving an icon corresponding to an executing application program to the curved-surface touch-screen region in response to a folding angle of the internal foldable touch-screen region when a folding operation of the internal foldable touch-screen region is performed (i.e., when the internal foldable touch-screen region is folded or unfolded).

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
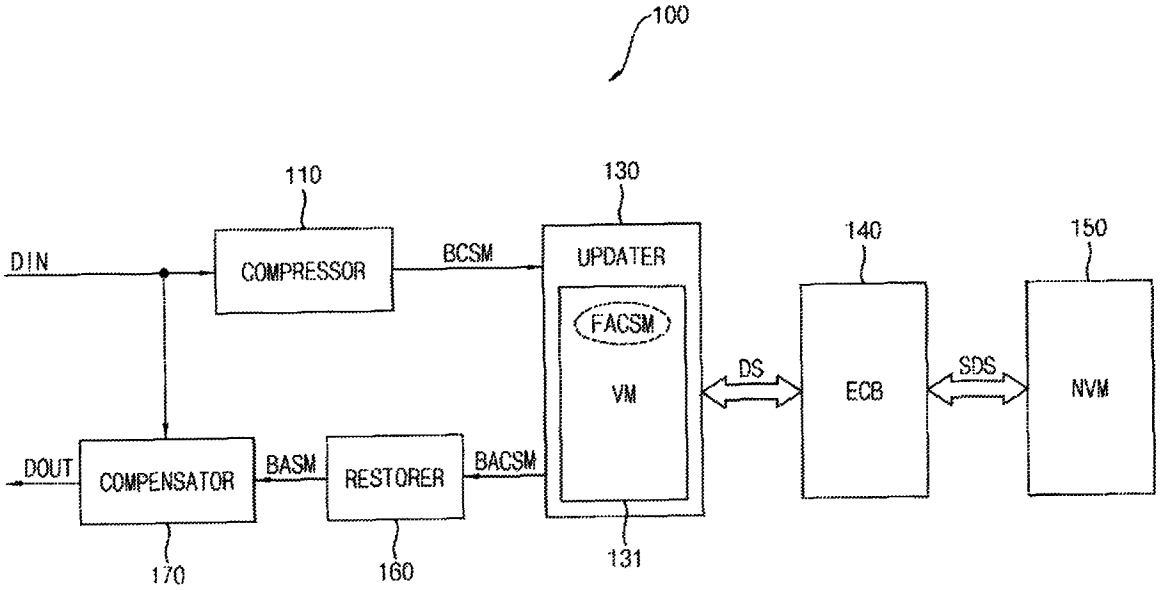
FIG. 1 is a block diagram illustrating an exemplary embodiment of a degradation compensator.

Various exemplary embodiments will be described more fully hereinafter with reference to the accompanying drawings, in which exemplary embodiments are shown. The invention may, however, be embodied in many different forms and should not be construed as limited to the exemplary embodiments set forth herein. Rather, these exemplary embodiments are provided so that this invention will be thorough and complete, and will fully convey the scope of the invention to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a degradation compensator according to an exemplary embodiment.

Referring to FIG. 1, a degradation compensator 100 includes a compressor 110, a non-volatile memory device NVM 150, an updater 130, an error corrector ECB 140, a restorer 160, and an internal compensator 170.

The compressor 110 generates a block-level compression stress matrix BCSM representing a degradation level of a first block included in a frame by R, G, and B input signals DIN of the first block.

The updater 130 includes a volatile memory VM 131. The updater 130 updates a frame-level accumulated compression stress matrix ("FACSM") by adding the BCSM to the FACSM. The FACSM is stored in the volatile memory 131. The FACSM represents an accumulated degradation level of the frame.

The error corrector 140 receives elements of a block-level accumulated compression stress matrix BACSM included in the FACSM through the data signal DS, executes error-correction encoding to the elements with different intensities, and writes the encoded elements as a storage data SDS of the non-volatile memory device 150 when a power supply is stopped. The error corrector 140 executes error-correction decoding to the storage data SDS and writes the decoded storage data as the FACSM of the volatile memory 131 through data signal DS when the power supply is started.

The restorer 160 generates a block-level accumulated stress matrix BASM by restoring a BACSM corresponding to the first block among the FACSM. The internal compensator 170 generates compensated R, G, and B output signals DOUT corresponding to the first block by adding the R, G, and B input signals DIN and data compensation values generated based on the BASM.

Figure 2:
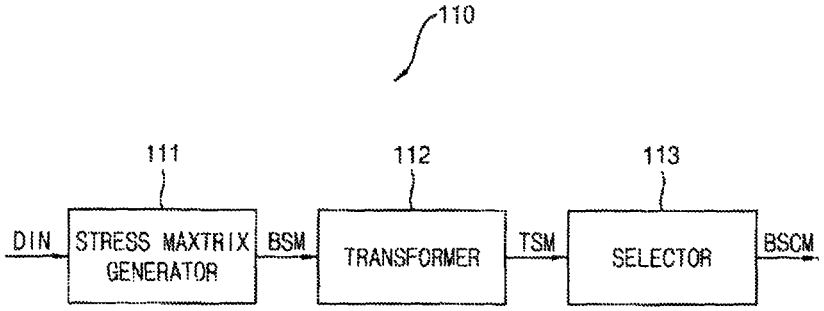
FIG. 2 is a block diagram illustrating the compressor included in the degradation compensator of FIG. 1.

FIG. 2 is a block diagram illustrating the compressor included in the degradation compensator of FIG. 1.

Referring to FIG. 2, the compressor 110 may include a stress matrix generator 111, a transformer 112, and a selector 113.

The stress matrix generator 111 may generate a block-level stress matrix BSM corresponding to the first block based on the R, G, and B input signals DIN. In an exemplary embodiment, the BSM may be a two by two (i.e., 2×2) matrix, a four by four (i.e., 4×4) matrix, a sixteen by sixteen (i.e., 16×16) matrix, or a user-determined arbitrary size matrix, for example. Procedure to generate the BSM is well-known to a person having ordinary skill in the art, thereby the detailed description may be omitted.

The transformer 112 may generate a transformed stress matrix TSM by applying linear transformation to the BSM. In an exemplary embodiment, the linear transformation may be the DCT, the hadamard transformation, or the haar transformation, for example. In another exemplary embodiment, the linear transformation may be one of general linear transformations which are well-known to a person having ordinary skill in the art, thereby the detailed description may be omitted.

The selector 113 may generate the BCSM by selecting a portion of the TSM.

Figure 3:
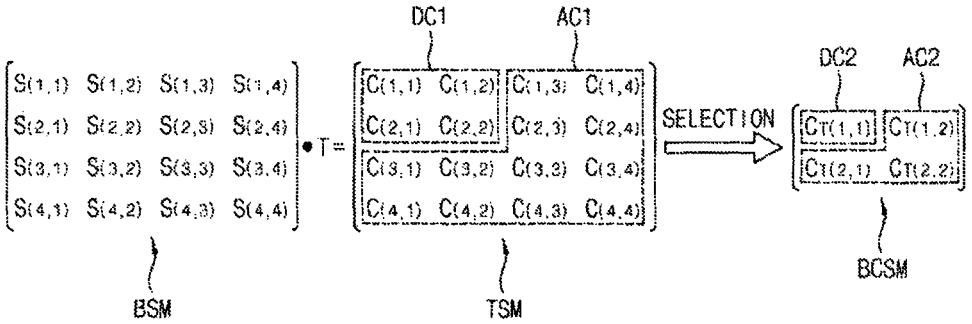
FIG. 3 is a diagram illustrating operation of the compressor of FIG. 2.

FIG. 3 is a diagram illustrating operation of the compressor of FIG. 2.

FIG. 3 shows a case that the BSM is a 4×4 matrix, and the BCSM is a 2×2 matrix, for example.

The stress matrix generator 111 may generate BSM representing a degradation level (stress) of the block (4×4 matrix) by R, G, and B input signals DIN of each of 16 pixels included in the block. The (1, 1)-th element S(1, 1) of the BSM represents a stress of the (1, 1)-th pixel included in the block. The (1, 2)-th element S(1, 2) of the BSM represents a stress of the (1, 2)-th pixel included in the block. Remaining elements of the BSM may be understood based on the description.

The transformer 112 generates the TSM by multiplying the BSM and the linear transformation T. In an exemplary embodiment, when the linear transformation T is a DCT, and the (1, 1)-th, (1, 2)-th, (2, 1)-th, and (2, 2)-th elements C(1, 1), C(1, 2), C(2, 1), and C(2, 2) of the TSM may be low-frequency elements DC1 of the TSM, and the (1, 3)-th, (1, 4)-th, (2, 3)-th, (2, 4)-th, (3, 1)-th, (3, 2)-th, (3, 3)-th, (3, 4)-th, (4, 1)-th, (4, 2)-th, (4, 3)-th, and (4, 4)-th elements C(1, 3), C(1, 4), C(2, 3), C(2, 4), C(3, 1), C(3, 2), C(3, 3), C(3, 4), C(4, 1), C(4, 2), C(4, 3), and C(4, 4) of the TSM may be high-frequency elements AC1 of the TSM.

In an exemplary embodiment, the linear transformation T is the DCT, and the selector 113 may generate the BCSM by selecting the low-frequency elements DC1 of the TSM. In detail, the (1, 1)-th element CT(1, 1) of the BCSM may be the (1, 1)-th element C(1, 1) of the TSM, the (1, 2)-th element CT(1, 2) of the BCSM may be the (1, 2)-th element C(1, 2) of the TSM, the (2, 1)-th element CT(2, 1) of the BCSM may be the (2, 1)-th element C(2, 1) of the TSM, and the (2, 2)-th element CT(2, 2) of the BCSM may be the (2, 2)-th element C(2, 2) of the TSM.

In an exemplary embodiment, the linear transformation T is the hadarmard transformation, and the selector 113 may generate the BCSM by selecting predetermined elements of the TSM. In detail, the (1, 1)-th element CT(1, 1) of the BCSM may be the (1, 1)-th element C(1, 1) of the TSM, the (1, 2)-th element CT(1, 2) of the BCSM may be the (1, 3)-th element C(1, 3) of the TSM, the (2, 1)-th element CT(2, 1) of the BCSM may be the (3, 1)-th element C(3, 1) of the TSM, and the (2, 2)-th element CT(2, 2) of the BCSM may be the (3, 3)-th element C(3, 3) of the TSM.

In an exemplary embodiment, the linear transformation may T be the haar transformation, for example.

The (1, 1)-th element CT(1, 1) of the BCSM may be low-frequency element DC2 of the BCSM, and the (1, 2)-th, (2, 1)-th, and (2, 2)-th elements CT(1, 2), CT(2, 1), and CT(2, 2) of the BCSM may be high-frequency element AC2 of the BCSM.

The restorer 160 may generate BASM by applying inverse procedure of compression procedure of FIG. 3 to the BACSM.

Figure 4:
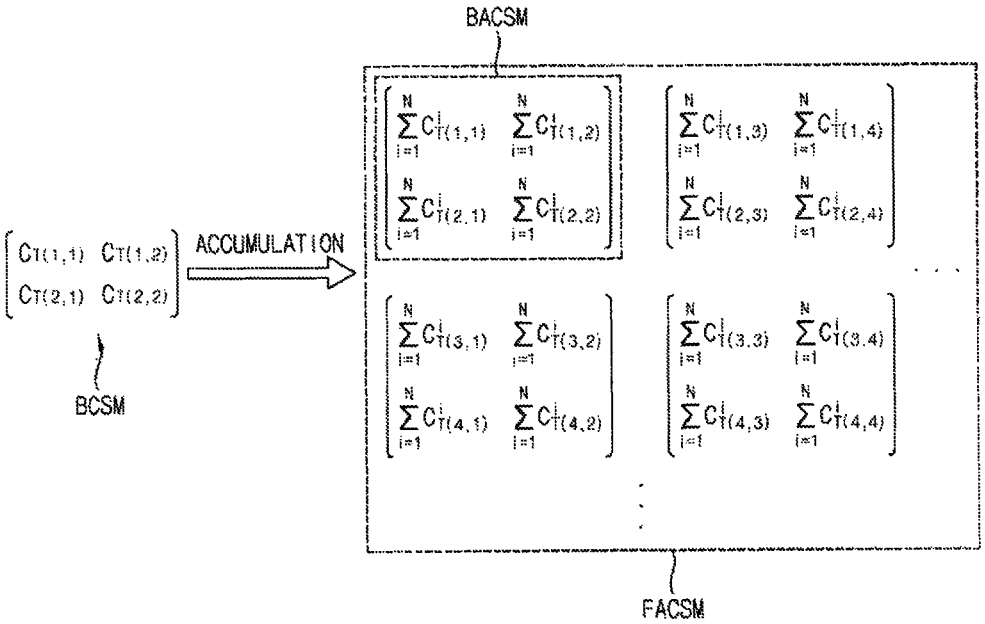
FIG. 4 is a diagram illustrating operation of the updater included in the degradation compensator of FIG. 1.

FIG. 4 is a diagram illustrating operation of the updater included in the degradation compensator of FIG. 1.

Referring to FIG. 4, the updater 130 updates the FACSM by adding the BCSM, which corresponds to the first block, to the first BACSM, which corresponds to the first block, among the FACSM. The first BACSM is a matrix accumulating BCSMs corresponding to the first block included in the first frame through the N-th frame (N is a natural number).

Figure 5:
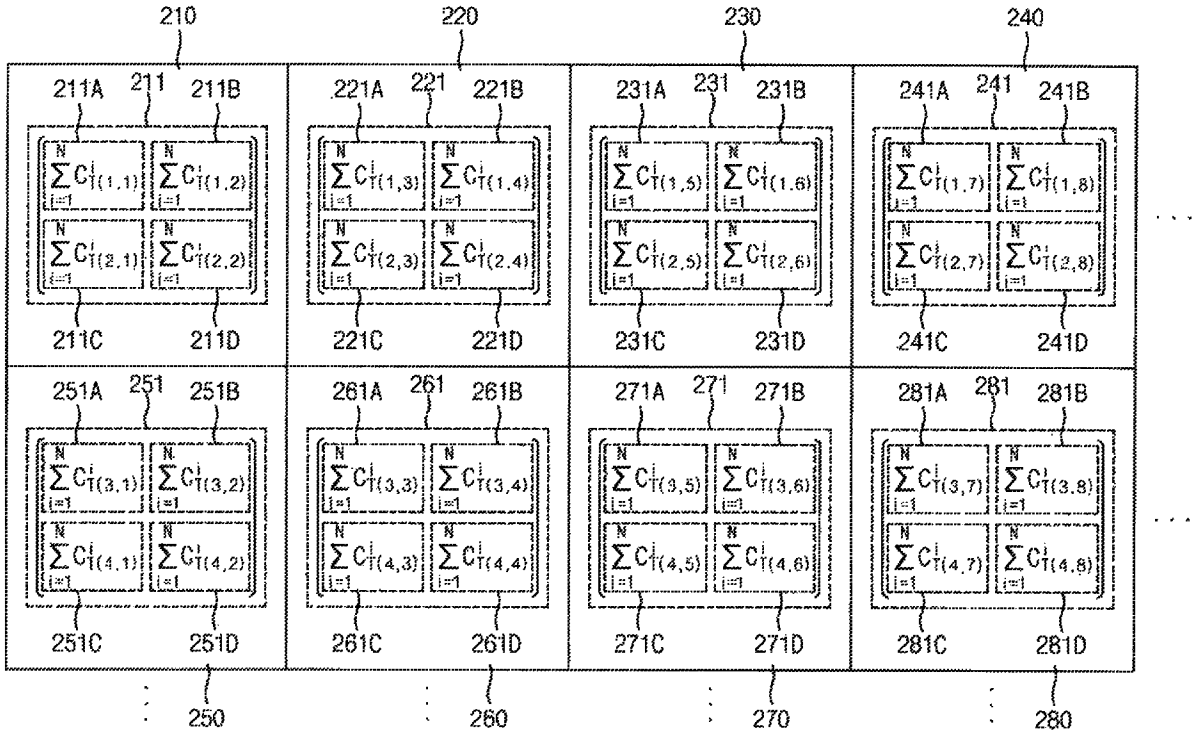
FIG. 5 is a diagram illustrating a frame-level accumulated compression stress matrix ("FACSM") stored in the volatile memory of the updater included in the degradation compensator of FIG. 1.

FIG. 5 is a diagram illustrating a FACSM stored in the volatile memory of the updater included in the degradation compensator of FIG. 1.

Referring to FIG. 5, the frame may include the first through eighth blocks 210, 220, 230, 240, 250, 260, 270, and 280. The FACSM includes the first through eighth BACSMs 211, 221, 231, 241, 251, 261, 271, and 281. The first BACSM 211 corresponds to the first block 210, and includes low-frequency element 211A and high-frequency elements 211B, 211C, and 211D. The second BACSM 221 corresponds to the second block 220, and includes low-frequency element 221A and high-frequency elements 221B, 221C, and 221D. The third through eighth BACSMs 231, 241, 251, 261, 271, and 281 may be understood based on the description.

Figure 6:
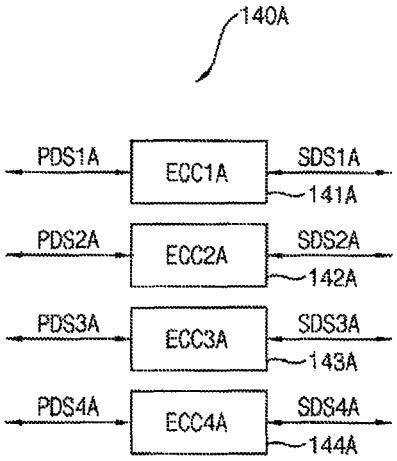
FIG. 6 is a block diagram illustrating an exemplary embodiment of the error corrector included in the degradation compensator of FIG. 1.

FIG. 6 is a block diagram illustrating an exemplary embodiment of the error corrector included in the degradation compensator of FIG. 1. FIGS. 7 through 10 are diagrams illustrating operation of the error corrector of FIG. 6.

Referring to FIG. 6, the error corrector 140A may include the first through fourth error correction units 141A, 142A, 143A, and 144A. In an exemplary embodiment, the error corrector 140A may include additional error correction units other than the first through fourth error correction units 141A, 142A, 143A, and 144A. In another exemplary embodiment, the error corrector 140A may include error correction units less than the first through fourth error correction units 141A, 142A, 143A, and 144A.

Referring to FIGS. 6 to 10, the first error correction unit 141A may receive low-frequency elements 211A, 221A, 231A, 241A, 251A, 261A, 271A, and 281A as the first partial data signal PDS1A, and execute error-correction encoding to low-frequency elements 211A, 221A, 231A, 241A, 251A, 261A, 271A, and 281A with the first intensity and writes the encoded low-frequency elements as the first storage data SDS1A of the non-volatile memory device 150. The second error correction unit 142A may receive the first high-frequency elements 211B, 221B, 231B, 241B, 251B, 261B, 271B, and 281B as the second partial data signal PDS2A, and execute error-correction encoding to the first high-frequency elements 211B, 221B, 231B, 241B, 251B, 261B, 271B, and 281B with the second intensity and writes the encoded first high-frequency elements as the second storage data SDS2A of the non-volatile memory device 150. The third error correction unit 143A may receive the second high-frequency elements 211C, 221C, 231C, 241C, 251C, 261C, 271C, and 281C as the third partial data signal PDS3A, and execute error-correction encoding to the second high-frequency elements 211C, 221C, 231C, 241C, 251C, 261C, 271C, and 281C with the third intensity and writes the encoded second high-frequency elements as the third storage data SDS3A of the non-volatile memory device 150. The fourth error correction unit 144A may receive the third high-frequency elements 211D, 221D, 231D, 241D, 251D, 261D, 271D, and 281D as the fourth partial data signal PDS4A, and execute error-correction encoding to the third high-frequency elements 211D, 221D, 231D, 241D, 251D, 261D, 271D, and 281D with the fourth intensity and writes the encoded third high-frequency elements as the fourth storage data SDS4A of the non-volatile memory device 150.

Because importance of the low-frequency elements 211A, 221A, 231A, 241A, 251A, 261A, 271A, and 281A is larger than importance of the first high-frequency elements 211B, 221B, 231B, 241B, 251B, 261B, 271B, and 281B and importance of the second high-frequency elements 211C, 221C, 231C, 241C, 251C, 261C, 271C, and 281C, the first intensity may be equal to or larger than the second intensity, and the first intensity may be equal to or larger than the third intensity. In other words, the number of parity bits generated by the first error correction unit 141A is equal to or larger than the number of parity bits generated by the second error correction unit 142A and the third error correction unit 143A.

Because importance of the first high-frequency elements 211B, 221B, 231B, 241B, 251B, 261B, 271B, and 281B and importance of the second high-frequency elements 211C, 221C, 231C, 241C, 251C, 261C, 271C, and 281C are larger than importance of the third high-frequency elements 211D, 221D, 231D, 241D, 251D, 261D, 271D, and 281D, the second intensity may be equal to or larger than the fourth intensity, and the third intensity may be equal to or larger than the fourth intensity. In other words, the number of parity bits generated by the second error correction unit 142A and the third error correction unit 143A are equal to or larger than the number of parity bits generated by the fourth error correction unit 144A.

Figure 7:
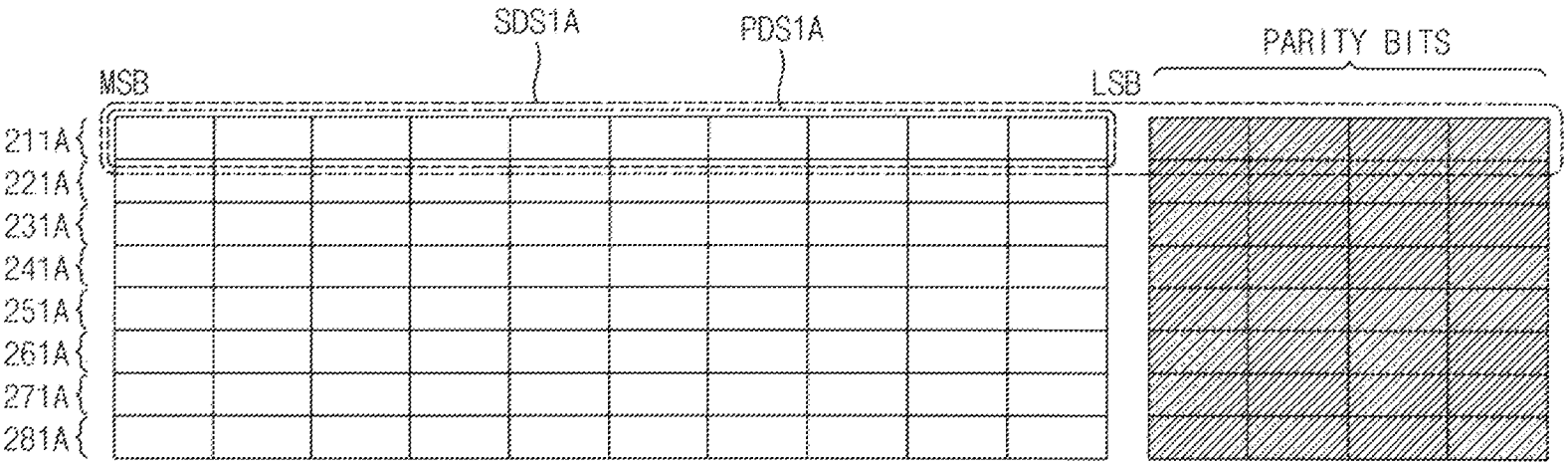
FIGS. 7 through 10 are diagrams illustrating operation of the error corrector of FIG. 6.
Figure 8:
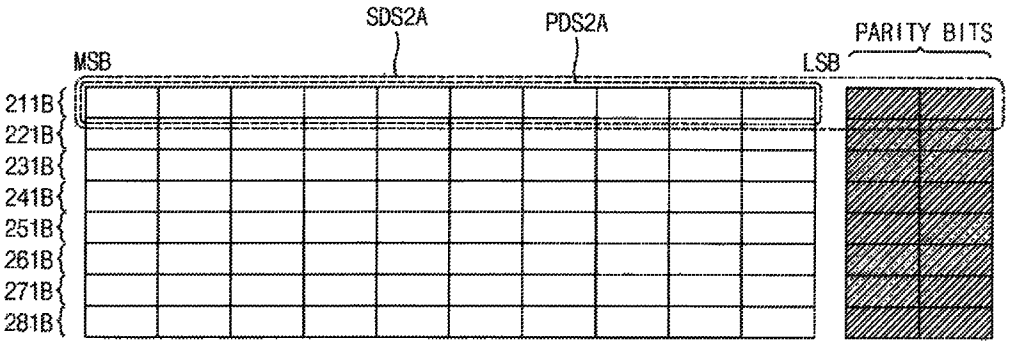
Figure 9:
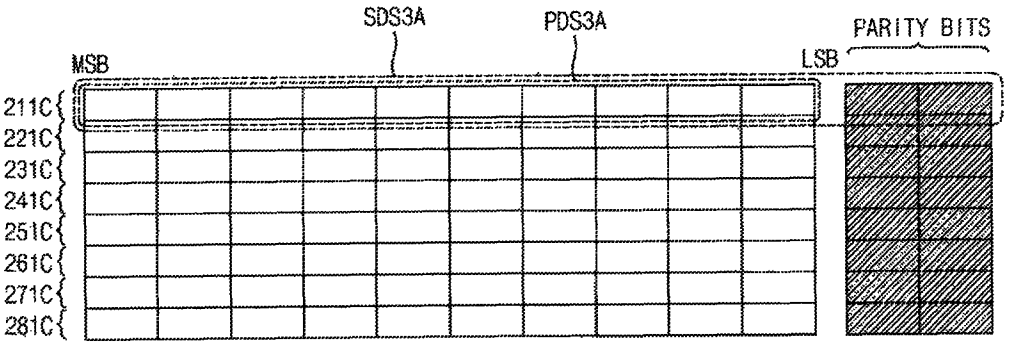
Figure 10:
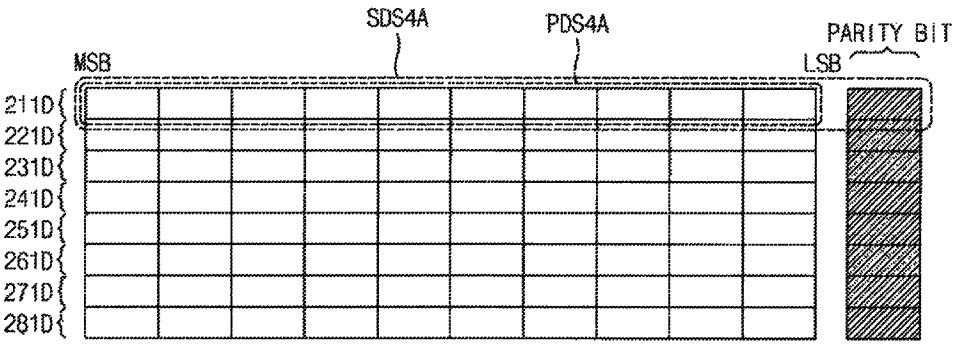

Referring to FIGS. 6 and 7, the first error correction unit 141A generates the first storage data SDS1A including four parity bits by executing error correction encoding to the low-frequency elements 211A, 221A, 231A, 241A, 251A, 261A, 271A, and 281A received as the first partial data signal PDS1A. Referring to FIGS. 6 and 8, the second error correction unit 142A generates the second storage data SDS2A including two parity bits by executing error correction encoding to the first high-frequency elements 211B, 221B, 231B, 241B, 251B, 261B, 271B, and 281B received as the second partial data signal PDS2A. Referring to FIGS. 6 and 9, the third error correction unit 143A generates the third storage data SDS3A including two parity bits by executing error correction encoding to the second high-frequency elements 211C, 221C, 231C, 241C, 251C, 261C, 271C, and 281C received as the third partial data signal PDS3A. Referring to FIGS. 6 and 10, the fourth error correction unit 144A generates the fourth storage data SDS4A including 1 parity bit by executing error correction encoding to the third high-frequency elements 211D, 221D, 231D, 241D, 251D, 261D, 271D, and 281D received as the fourth partial data signal PDS4A.

Figure 11:
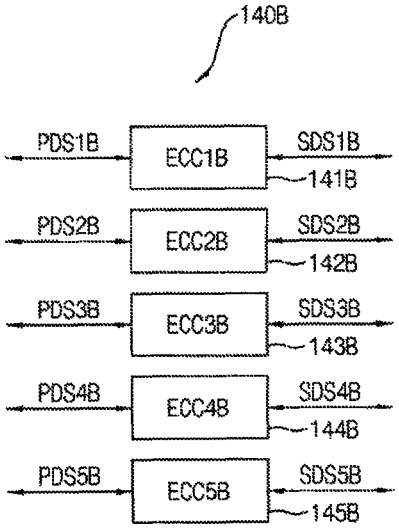
FIG. 11 is a block diagram illustrating another exemplary embodiment of the error corrector included in the degradation compensator of FIG. 1.
Figure 12:
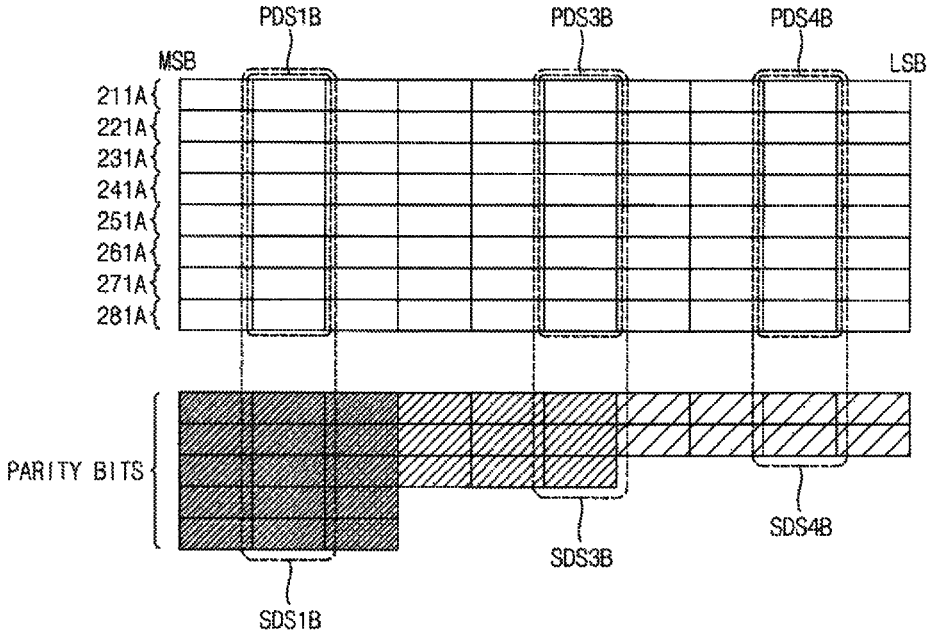
FIGS. 12 through 15 are diagrams illustrating operation of the error corrector of FIG. 11.
Figure 13:
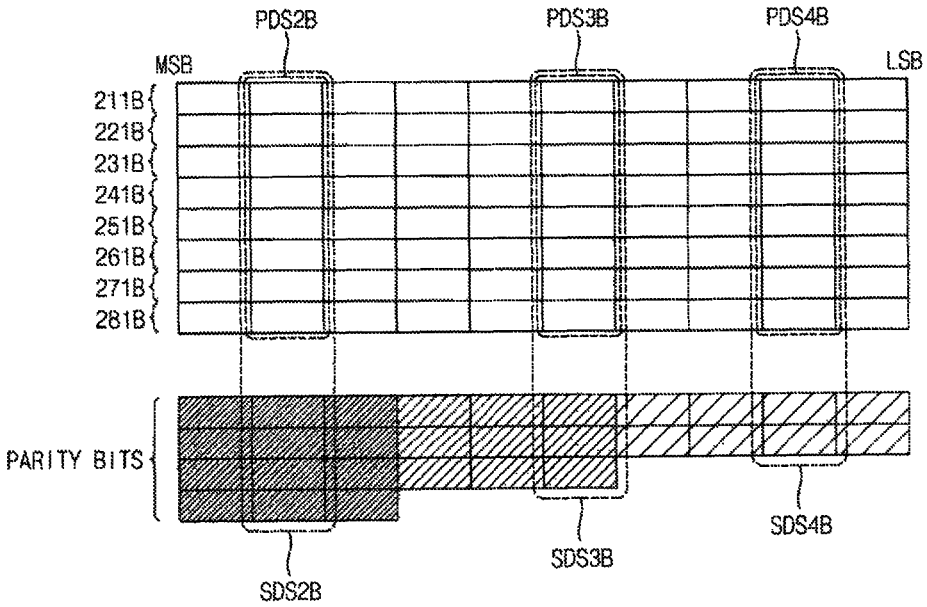
Figure 14:
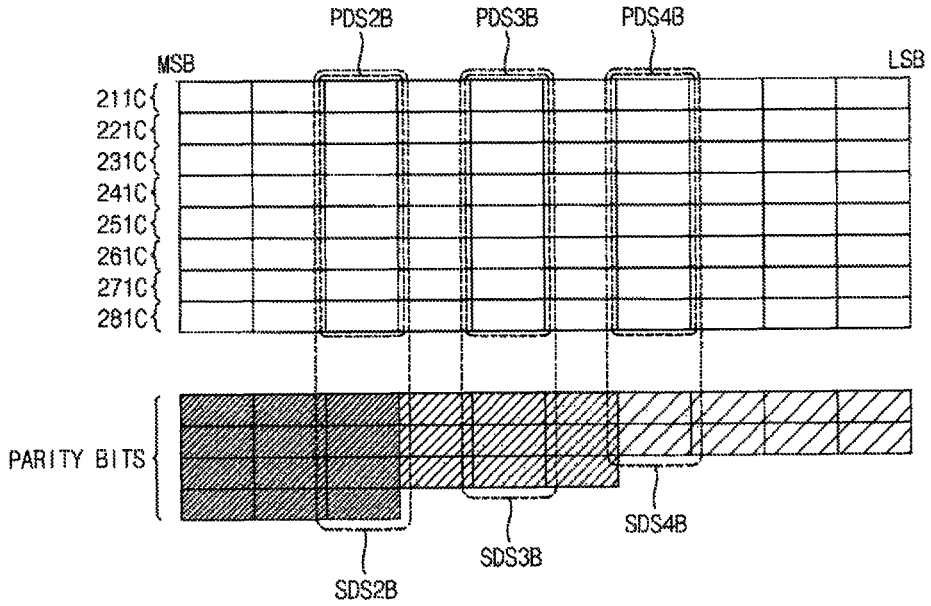
Figure 15:
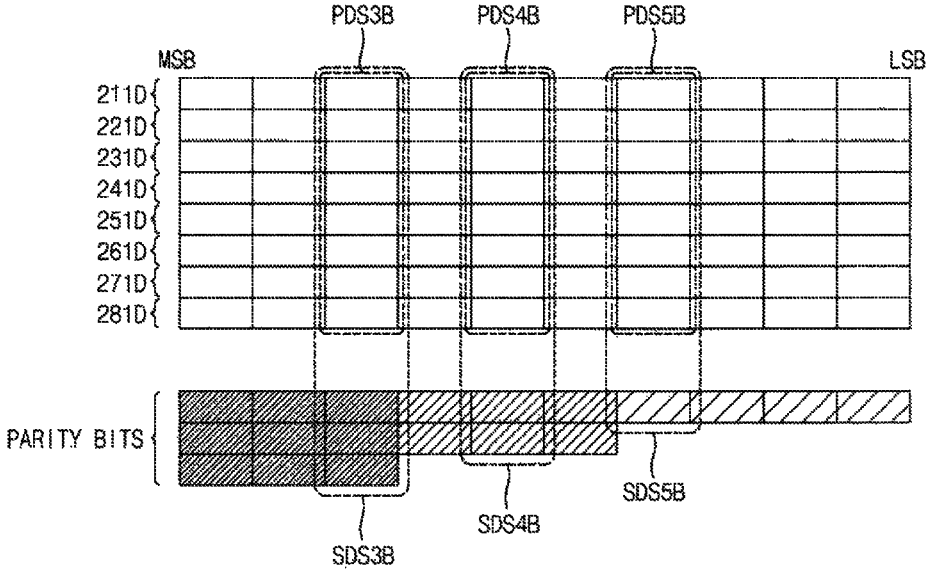

FIG. 11 is a block diagram illustrating another exemplary embodiment of the error corrector included in the degradation compensator of FIG. 1.

Referring to FIG. 11, the error corrector 140B may include the first through fifth error correction units 141B, 142B, 143B, 144B, and 145B. In an exemplary embodiment, the error corrector 140B may include additional error correction units other than the first through fifth error correction units 141B, 142B, 143B, 144B, and 145B. In another exemplary embodiment, the error corrector 140B may include error correction units less than the first through fifth error correction units 141B, 142B, 143B, 144B, and 145B.

The first error correction unit 141B may execute error-correction encoding to the first partial data signal PDS1B with five parity bits and write the encoded data as the first storage data SDS1B of the non-volatile memory device 150. The second error correction unit 142B may execute error-correction encoding to the second partial data signal PDS2B with four parity bits and write the encoded data as the second storage data SDS2B of the non-volatile memory device 150. The third error correction unit 143B may execute error-correction encoding to the third partial data signal PDS3B with three parity bits and write the encoded data as the third storage data SDS3B of the non-volatile memory device 150. The fourth error correction unit 144B may execute error-correction encoding to the fourth partial data signal PDS4B with two parity bits and write the encoded data as the fourth storage data SDS4B of the non-volatile memory device 150. The fifth error correction unit 145B may execute error-correction encoding to the fifth partial data signal PDS5B with 1 parity bit and write the encoded data as the fifth storage data SDS5B of the non-volatile memory device 150.

FIGS. 12 through 15 are diagrams illustrating operation of the error corrector of FIG. 11. FIGS. 12 through 15 show a case that sizes of elements of the FACSM are 10 bit respectively, for example.

Referring to FIGS. 12 through 15, the first error correction unit 141B generates the first storage data SDS1B including five parity bits by executing error correction encoding to the upper 3 bits from the most significant bit ("MSB") of the low-frequency elements 211A, 221A, 231A, 241A, 251A, 261A, 271A, and 281A received as the first partial data signal PDS1B. The second error correction unit 142B generates the second storage data SDS2B including four parity bits by executing error correction encoding to the upper 3 bits from the most significant bit ("MSB") of the first high-frequency elements 211B, 221B, 231B, 241B, 251B, 261B, 271B, and 281B received as the second partial data signal PDS2B. The third error correction unit 143B generates the third storage data SDS3B including three parity bits by executing error correction encoding to (1) median 3 bits of the low-frequency elements 211A, 221A, 231A, 241A, 251A, 261A, 271A, and 281A, (2) median 3 bits of the first high-frequency elements 211B, 221B, 231B, 241B, 251B, 261B, 271B, and 281B, (3) median 3 bits of the second high-frequency elements 211C, 221C, 231C, 241C, 251C, 261C, 271C, and 281C, and (4) upper 3 bits of the third high-frequency elements 211D, 221D, 231D, 241D, 251D, 261D, 271D, and 281D received as the third partial data signal PDS3B. The fourth error correction unit 144B generates the fourth storage data SDS4B including two parity bits by executing error correction encoding to (1) lower 4 bits from the least significant bit ("LSB") of the low-frequency elements 211A, 221A, 231A, 241A, 251A, 261A, 271A, and 281A, (2) lower 4 bits of the first high-frequency elements 211B, 221B, 231B, 241B, 251B, 261B, 271B, and 281B, (3) lower 4 bits of the second high-frequency elements 211C, 221C, 231C, 241C, 251C, 261C, 271C, and 281C, and (4) median 3 bits of the third high-frequency elements 211D, 221D, 231D, 241D, 251D, 261D, 271D, and 281D received as the fourth partial data signal PDS4B. The fifth error correction unit 145B generates the fifth storage data SDS5B including 1 parity bit by executing error correction encoding to the lower 4 bits of the third high-frequency elements 211D, 221D, 231D, 241D, 251D, 261D, 271D, and 281D received as the fifth partial data signal PDS5B.

Figure 16:
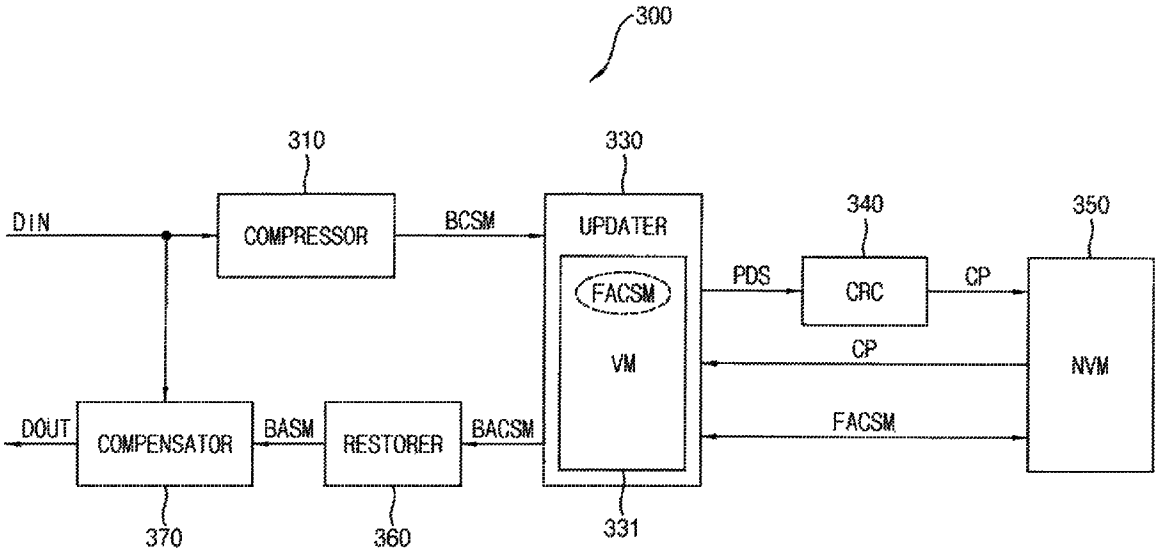
FIG. 16 is a block diagram illustrating another exemplary embodiment of a degradation compensator.

FIG. 16 is a block diagram illustrating a degradation compensator according to another exemplary embodiment.

Referring to FIG. 16, a degradation compensator 300 includes a compressor 310, a non-volatile memory device 350, an updater 330, a cyclic redundancy checker 340, a restorer 360, and an internal compensator 370.

The compressor 310 generates a block-level compression stress matrix BCSM representing a degradation level of a first block included a frame by R, G, and B input signals DIN of the first block. The compressor 310 may have the same or similar structure with the compressor 110 of FIG. 2. The compressor 310 may be understood based on the references to FIGS. 2 and 3.

The updater 330 includes a volatile memory 331. The updater 330 updates a FACSM by adding the BCSM to the FACSM when an enable signal is activated. The FACSM is stored in the volatile memory 331. The FACSM represents an accumulated degradation level of the frame. Procedure that the updater 330 updates the FACSM may be understood based on the reference to FIG. 4. The FACSM may be understood based on the reference to FIG. 5.

The updater 330 outputs a portion of elements of a block-level accumulated compression stress matrix BACSM included in the FACSM as a partial data signal PDS sequentially when a power supply is stopped. The partial data signal PDS will be described in reference to FIG. 17.

The cyclic redundancy checker SRC 340 generates a cyclic redundancy check ("CRC") parity CP by executing cyclic redundancy check to the partial data signal PDS and writes the CRC parity CP to the non-volatile memory device 350 when the power supply is stopped.

The updater 330 reads the CRC parity CP and the FACSM from the non-volatile memory device 350 when the power supply is started, and the updater 330 activates or deactivates the enable signal by comparing the read CRC parity and a CRC parity which is re-generated from the read FACSM.

The restorer 360 generates a block-level accumulated stress matrix BASM by restoring a BACSM corresponding to the first block among the FACSM. The internal compensator 370 generates compensated R, G, and B output signals DOUT corresponding to the first block by adding the R, G, and B input signals DIN and data compensation values generated based on the BASM.

In an exemplary embodiment, the updater 330 may activate the enable signal such that the FACSM can be updated when the read CRC parity is the same as the re-generated CRC parity. The updater 330 may deactivate the enable signal such that the FACSM cannot be updated when the read CRC parity is different from the re-generated CRC parity.

Figure 17:
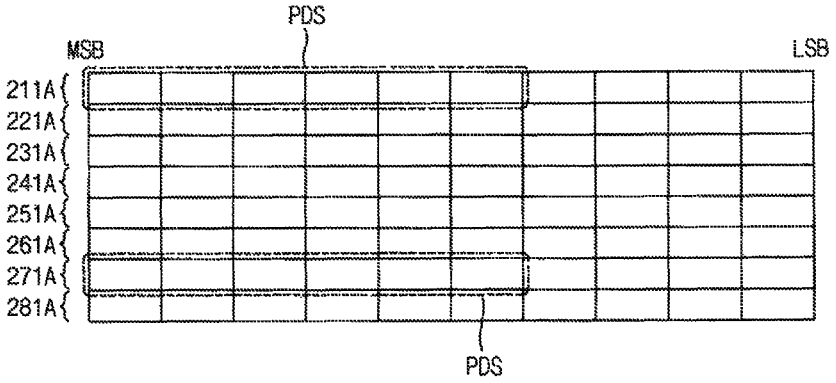
FIG. 17 is a diagram illustrating the partial data signal outputted from the updater included in the degradation compensator of FIG. 16.

FIG. 17 is a diagram illustrating the partial data signal outputted from the updater included in the degradation compensator of FIG. 16.

Referring to FIG. 16, the partial data signal PDS may be upper bits of the low-frequency elements 211A, 221A, 231A, 241A, 251A, 261A, 271A, and 281A.

Figure 18:
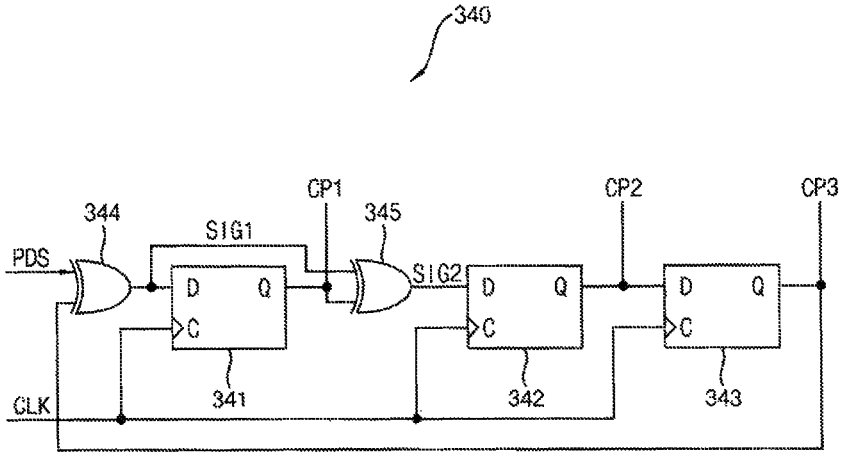
FIG. 18 is a block diagram illustrating the cyclic redundancy checker included in the degradation compensator of FIG. 16.

FIG. 18 is a block diagram illustrating the cyclic redundancy checker included in the degradation compensator of FIG. 16.

FIG. 18 shows a case that the CRC parity CP may include first through third CRC parity bits CP1, CP2, and CP3. In an exemplary embodiment, the CRC parity CP may include additional parity bits other than the first through third CRC parity bits CP1, CP2, and CP3. In another exemplary embodiment, the CRC parity CP may include parity bits less than the first through third CRC parity bits CP1, CP2, and CP3.

The cyclic redundancy checker 340 may include first and second exclusive OR ("XOR") gates 344 and 345, and first through third D flip-flops 341, 342, and 343.

A first input terminal of the first XOR gate 344 may receive the partial data signal PDS, a second input terminal of the first XOR gate 344 may receive the third CRC parity bit CP3, and an output terminal of the first XOR gate 344 may output a first signal SIG1. A data input terminal of the first D flip-flop 341 may receive the first signal SIG1, a clock input terminal of the first D flip-flop 341 may receive a clock signal CLK, and a data output terminal of the first D flip-flop 341 may output the first CRC parity bit CP1. A first input terminal of the second XOR gate 345 may receive the first signal SIG1, a second input terminal of the second XOR gate 345 may receive the first CRC parity bit CP1, and the output terminal of the second XOR gate 345 may output a second signal SIG2. A data input terminal of the second D flip-flop 342 may receive the second signal SIG2, a clock input terminal of the second D flip-flop 342 may receive the clock signal CLK, and a data output terminal of the second D flip-flop 342 may output the second CRC parity bit CP2. A data input terminal of the third D flip-flop 343 may receive the second CRC parity bit CP2, a clock input terminal of the third D flip-flop 343 may receive the clock signal CLK, and a data output terminal of the third D flip-flop 343 may output the third CRC parity bit CP3.

Figure 19:
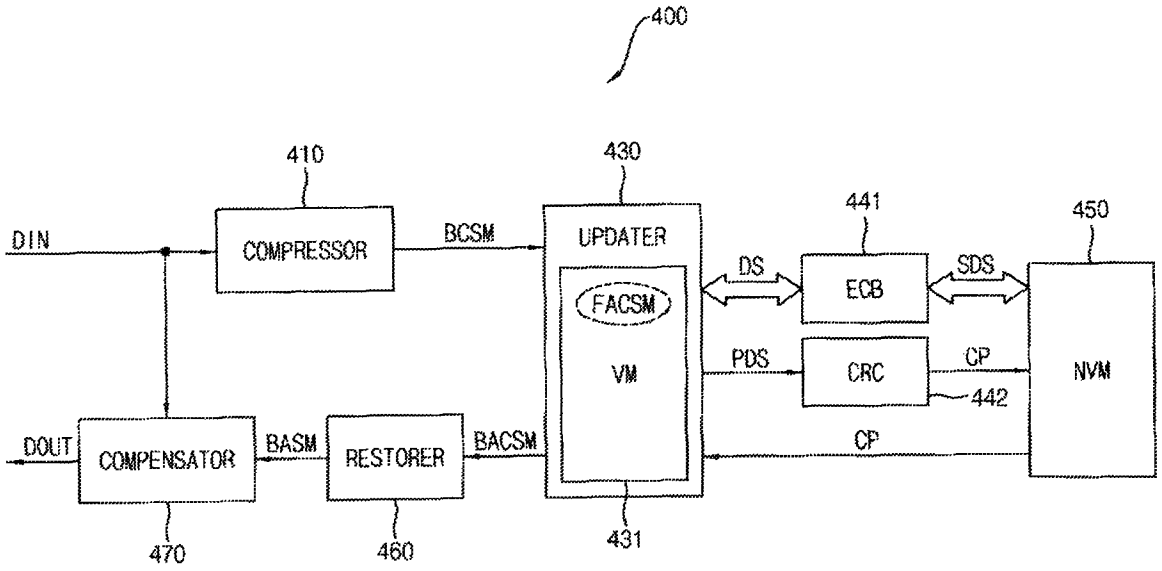
FIG. 19 is a block diagram illustrating another exemplary embodiment of a degradation compensator.

FIG. 19 is a block diagram illustrating a degradation compensator according to another exemplary embodiment.

Referring to FIG. 19, a degradation compensator 400 includes a compressor 410, a non-volatile memory device 450, an updater 430, an error corrector 441, a cyclic redundancy checker 442, a restorer 460, and an internal compensator 470.

The compressor 410 generates a block-level compression stress matrix BCSM representing a degradation level of a first block included in a frame by R, G, and B input signals DIN of the first block. The compressor 410 may have the same or similar structure with the compressor 110 of FIG. 2. The compressor 410 may be understood based on the references to FIGS. 2 and 3.

The updater 430 includes a volatile memory 431. The updater 430 updates a FACSM by adding the BCSM to the FACSM when an enable signal is activated. The FACSM is stored in the volatile memory 431. The FACSM represents an accumulated degradation level of the frame. Procedure that the updater 430 updates the FACSM may be understood based on the reference to FIG. 4. The FACSM may be understood based on the reference to FIG. 5.

The updater 430 outputs a portion of elements of a block-level accumulated compression stress matrix BACSM included in the FACSM as a partial data signal PDS sequentially when a power supply is stopped. The partial data signal PDS may be understood based on the reference to FIG. 17.

The error corrector 441 receives elements of a block-level accumulated compression stress matrix BACSM included in the FACSM through a data signal DS, executes error-correction encoding to the elements with different intensities and writes the encoded elements as a storage data SDS of the non-volatile memory device 450 when the power supply is stopped. The error corrector 441 executes error-correction decoding to the storage data SDS and writes the decoded storage data as FACSM of the volatile memory 431 when the power supply is started.

The cyclic redundancy checker 442 generates a CRC parity CP by executing cyclic redundancy check to the partial data signal PDS and writes the CRC parity CP to the non-volatile memory device 450 when the power supply is stopped.

The updater 430 reads the CRC parity CP from the non-volatile memory device 450 when the power supply is started. The updater 430 activates or deactivates the enable signal by comparing the read CRC parity and a CRC parity which is re-generated from the FACSM of the volatile memory 431 written by the error corrector 441.

In an exemplary embodiment, the updater 430 may activate the enable signal such that the FACSM can be updated when the read CRC parity is the same as the re-generated CRC parity. The updater 430 may deactivate the enable signal such that the FACSM cannot be updated when the read CRC parity is different from the re-generated CRC parity.

The restorer 460 generates a block-level accumulated stress matrix BASM by restoring a BACSM corresponding to the first block among the FACSM. The internal compensator 470 generates compensated R, G, and B output signals DOUT corresponding to the first block by adding the R, G, and B input signals DIN and data compensation values generated based on the BASM.

In an exemplary embodiment, the error corrector 441 may stop writing operation to the non-volatile memory device 150 when differences between elements of a FACSM, which is re-read from the non-volatile memory device 150, and elements of the updated FACSM exceed a predetermined range when the power supply is stopped. It's assumed that the re-read FACSM includes the first low-frequency element $$\left(\sum_{i=1}^{N} C_{TDC}^{i}\right)$$

and the first high-frequency element $$\left(\sum_{i=1}^{N} C_{TAC}^{i}\right),$$

and the updated FACSM includes the second low-frequency element $$\left(\sum_{i=1}^{N+n} C_{TDC}^{i}\right)$$

corresponding to the first low-frequency element $$\left(\sum_{i=1}^{N} C_{TDC}^{i}\right)$$

and the second high-frequency element $$\left(\sum_{i=1}^{N+n} C_{TAC}^{i}\right)$$

corresponding to the first high-frequency element $$\left(\sum_{i=1}^{N} C_{TAC}^{i}\right).$$

In an exemplary embodiment, when the second low-frequency element $$\left(\sum_{i=1}^{N+n} C_{TDC}^{i}\right)$$

becomes less than the first low-frequency element $$\left(\sum_{i=1}^{N} C_{TDC}^{i}\right),$$

because low-frequency element increases only, it means that error occurred. So, the error corrector 441 may stop writing operation corresponding to the updated FACSM to the non-volatile memory device 450.

In an exemplary embodiment, when difference $$\left(\sum_{i=1}^{N+n} C_{TDC}^{i} - \sum_{i=1}^{N} C_{TDC}^{i}\right)$$

between the second low-frequency element $$\left(\sum_{i=1}^{N+n} C_{TDC}^{i}\right)$$

and the first low-frequency element $$\left(\sum_{i=1}^{N} C_{TDC}^{i}\right)$$

is larger than low-frequency increase upper limit value ($\text{Threshold}_{DC}$), it means that error occurred on the second low-frequency element $$\left(\sum_{i=1}^{N+n} C_{TDC}^{i}\right).$$

So, the error corrector 441 may stop writing operation corresponding to the updated FACSM to the non-volatile memory device 450.

In an exemplary embodiment, when difference $$\left(\left|\sum_{i=1}^{N+n} C_{TAC}^{i} - \sum_{i=1}^{N} C_{TAC}^{i}\right|\right)$$

between the second high-frequency element $$\left(\sum_{i=1}^{N+n} C_{TAC}^{i}\right)$$

and the first high-frequency element $$\left(\sum_{i=1}^{N} C_{TAC}^{i}\right)$$

is larger than high-frequency increase upper limit value ($\text{Threshold}_{AC}$), it means that error occurred on the second high-frequency element $$\left(\sum_{i=1}^{N+n} C_{TAC}^{i}\right).$$

So, the error corrector 441 may stop writing operation corresponding to the updated FACSM to the non-volatile memory device 450.

Figure 20:
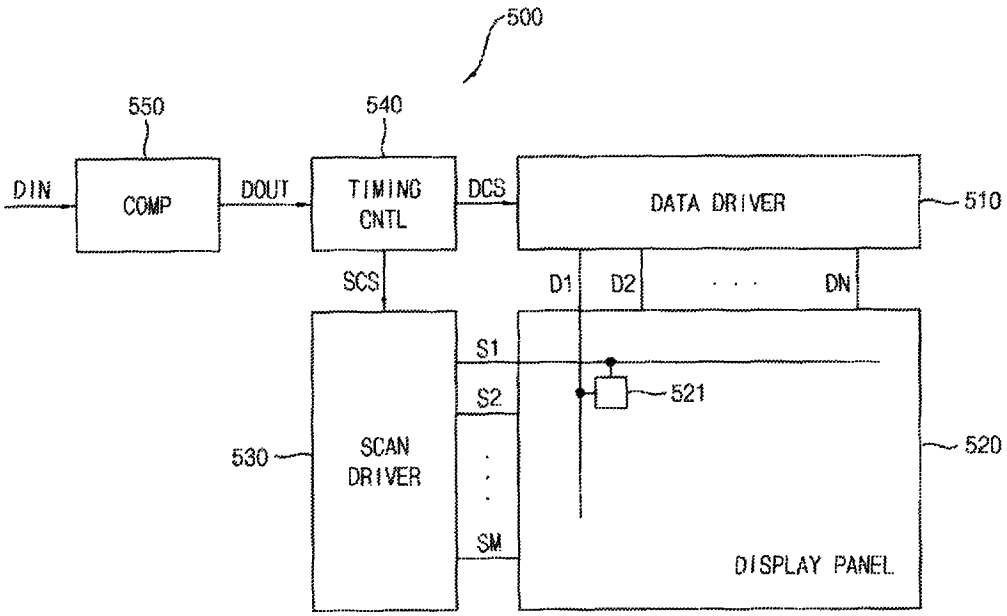
FIG. 20 is a block diagram illustrating an exemplary embodiment of a display device including a degradation compensator.

FIG. 20 is a block diagram illustrating a display device including a degradation compensator according to an exemplary embodiment.

Referring to FIG. 20, a display device 500 includes a degradation compensator COMP 550, a timing controller TIMING CNTRL 540, a display panel DISPLAY PANEL 520, a data driver DATA DRIVER 510, and a scan driver SCAN DRIVER 530.

The degradation compensator 550 generates data compensation values by accumulating stress by the R, G, and B input signals DIN, and outputs compensated R, G, and B output signals DOUT generated by adding the R, G, and B input signals DIN and the data compensation values. The degradation compensator 550 may have the same or similar structure with one of the degradation compensators 100, 300, and 400 of FIGS. 1, 16, and 19. The degradation compensator 550 may be understood based on the references to FIGS. 1 through 19.

The timing controller 540 generates a data driver control signal DCS and a scan driver control signal SCS based on the compensated R, G, and B output signals DOUT. The display panel 520 includes a plurality of pixels 521. The data driver 510 generates a plurality of data signals based on the data driver control signal DCS and provides the data signals to the plurality of the pixels 521 through a plurality of data signal lines D1, D2 through DN. The scan driver 530 generates a plurality of scan signals based on the scan driver control signal SCS. The scan driver 530 provides the scan signals to the plurality of the pixels 521 through a plurality of scan signal lines S1, S2 through SM.

Figure 21:
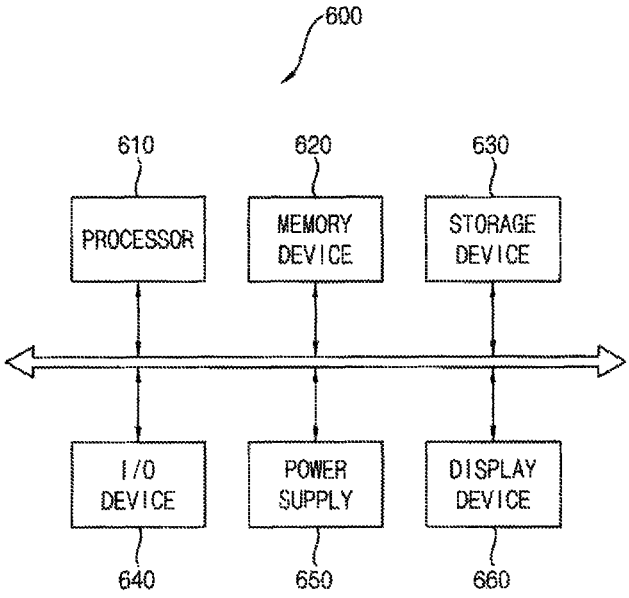
FIG. 21 is a block diagram illustrating an exemplary embodiment of an electronic device including the display device.

FIG. 21 is a block diagram illustrating an electronic device including the display device according to an exemplary embodiment.

Referring to FIG. 21, an electronic device 600 may include a processor 610, a memory device 620, a storage device 630, an input/output ("I/O") device 640, a power supply 650, and a display device 660. Here, the electronic device 600 may further include a plurality of ports for communicating a video card, a sound card, a memory card, a universal serial bus (USB) device, other electronic devices, etc. Although the electronic device 600 is implemented as a smart-phone, a kind of the electronic device 600 is not limited thereto.

The processor 610 may perform various computing functions. In an exemplary embodiment, the processor 610 may be a micro processor, a central processing unit ("CPU"), etc., for example. In an exemplary embodiment, the processor 610 may be coupled to other components via an address bus, a control bus, a data bus, etc. In an exemplary embodiment, the processor 610 may be coupled to an extended bus such as a peripheral component interconnection ("PCI") bus.

The memory device 620 may store data for operations of the electronic device 600. In an exemplary embodiment, the memory device 620 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile DRAM device, etc.

The storage device 630 may be a solid state drive ("SSD") device, a hard disk drive ("HDD") device, a CD-ROM device, etc. In an exemplary embodiment, the I/O device 640 may be an input device such as a keyboard, a keypad, a touchpad, a touch-screen, a mouse, etc, and an output device such as a printer, a speaker, etc. The power supply 650 may provide a power for operations of the electronic device 600. The display device 660 may communicate with other components via the buses or other communication links.

The display device 660 may be the display device 500 of FIG. 20. The display device 660 may be understood based on the references to FIGS. 1 through 20.

The exemplary embodiments may be applied to any electronic system 600 having the display device 660. In an exemplary embodiment, the embodiments may be applied to the electronic system 600, such as a digital or 3D television, a computer monitor, a home appliance, a laptop, a digital camera, a cellular phone, a smart phone, a personal digital assistant ("PDA"), a portable multimedia player ("PMP"), an MP3 player, a portable game console, a navigation system, a video phone, etc.

The invention may be applied to an OLED display device and an electronic device including the same. In an exemplary embodiment, the invention may be applied to a monitor, a television, a computer, a laptop computer, a digital camera, a mobile phone, a smartphone, a smart pad, a PDA, a PMP, an MP3 player, a navigation system, and camcorder.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A degradation compensator comprising:

a compressor which generates a block-level compression stress matrix representing a degradation level of a block included in a frame by R, G, and B input signals of the block;

a non-volatile memory device;

an updater which includes a volatile memory, updates a frame-level accumulated compression stress matrix by adding the block-level compression stress matrix to the frame-level accumulated compression stress matrix, the frame-level accumulated compression stress matrix stored in the volatile memory, the frame-level accumulated compression stress matrix representing an accumulated degradation level of the frame;

an error corrector which executes error-correction encoding to elements of a block-level accumulated compression stress matrix included in the frame-level accumulated compression stress matrix with different intensities and writes the encoded elements as a storage data of the non-volatile memory device when a power supply is stopped, and executes error-correction decoding to the storage data and writes the decoded storage data as the frame-level accumulated compression stress matrix of the volatile memory when the power supply is started;

a restorer which generates a block-level accumulated stress matrix by restoring the block-level accumulated compression stress matrix corresponding to the block among the frame-level accumulated compression stress matrix; and an internal compensator which generates compensated R, G, and B output signals corresponding to the block by adding the R, G, and B input signals and data compensation values generated based on the block-level accumulated stress matrix.

2. The degradation compensator of claim 1, wherein the elements include at least one low-frequency element and at least one high-frequency element.

3. The degradation compensator of claim 2, wherein an intensity of error-correction encoding applied to the at least one low-frequency element is equal to or larger than an intensity of error-correction encoding applied to the at least one high-frequency element.

4. The degradation compensator of claim 2, wherein a number of parity bits generated during error-correction encoding of the at least one low-frequency element is equal to or larger than a number of parity bits generated during error-correction encoding of the at least one high-frequency element.

5. The degradation compensator of claim 2, wherein an intensity of error-correction encoding applied to upper bits of the at least one low-frequency element is equal to or larger than an intensity of error-correction encoding applied to lower bits of the at least one low-frequency element, wherein an intensity of error-correction encoding applied to upper bits of the at least one high-frequency element is equal to or larger than an intensity of error-correction encoding applied to lower bits of the at least one high-frequency element.

6. The degradation compensator of claim 2, wherein a number of parity bits generated during error-correction encoding of upper bits of the at least one low-frequency element is equal to or larger than a number of parity bits generated during error-correction encoding of lower bits of the at least one low-frequency element, wherein the number of parity bits generated during error-correction encoding of upper bits of the at least one high-frequency element is equal to or larger than the number of parity bits generated during error-correction encoding of lower bits of the at least one high-frequency element.

7. The degradation compensator of claim 1, wherein the compressor includes:

a stress matrix generator which generates a block-level stress matrix corresponding to the block based on the R, G, and B input signals;

a transformer which generates a transformed stress matrix by applying a linear transformation to the block-level stress matrix; and a selector which generates the block-level compression stress matrix by selecting a portion of the transformed stress matrix.

8. The degradation compensator of claim 7, wherein, when the block-level stress matrix is a 4 by 4 matrix and the linear transformation is a discrete cosine transformation, the selector generates the block-level compression stress matrix by selecting a (1, 1)-th element, a (1, 2)-th element, a (2, 1)-th element, and a (2, 2)-th element of the transformed stress matrix, which are low-frequency elements of the transformed stress matrix.

9. The degradation compensator of claim 7, wherein, when the block-level stress matrix is a 4 by 4 matrix and the linear transformation is a hadamard transformation, the selector generates the block-level compression stress matrix by selecting a (1, 1)-th element, a (1, 3)-th element, a (3, 1)-th element, and a (3, 3)-th element of the transformed stress matrix.

10. The degradation compensator of claim 7, wherein the linear transformation is a haar transformation.

11. A degradation compensator comprising:

a compressor which generates a block-level compression stress matrix representing a degradation level of a block included in a frame by R, G, and B input signals of the block;

a non-volatile memory device;

an updater which includes a volatile memory, updates a frame-level accumulated compression stress matrix by adding the block-level compression stress matrix to the frame-level accumulated compression stress matrix when an enable signal is activated, the frame-level accumulated compression stress matrix stored in the volatile memory, the frame-level accumulated compression stress matrix representing an accumulated degradation level of the frame, the updater which outputs a portion of elements of a block-level accumulated compression stress matrix included in the frame-level accumulated compression stress matrix as a partial data signal sequentially when a power supply is stopped;

a cyclic redundancy checker which generates a cyclic redundancy check parity by executing a cyclic redundancy check to the partial data signal and writes the cyclic redundancy check parity to the non-volatile memory device when the power supply is stopped;

a restorer which generates a block-level accumulated stress matrix by restoring the block-level accumulated compression stress matrix corresponding to the block among the frame-level accumulated compression stress matrix; and an internal compensator which generates compensated R, G, and B output signals corresponding to the block by adding the R, G, and B input signals and data compensation values generated based on the block-level accumulated stress matrix, wherein the updater reads the cyclic redundancy check parity and the frame-level accumulated compression stress matrix from the non-volatile memory device when the power supply is started, and the updater activates or deactivates the enable signal by comparing the read cyclic redundancy check parity and a cyclic redundancy check parity which is re-generated from the read frame-level accumulated compression stress matrix.

12. The degradation compensator of claim 11, wherein the updater activates the enable signal when the read cyclic redundancy check parity is the same as the re-generated cyclic redundancy check parity, wherein the updater deactivates the enable signal when the read cyclic redundancy check parity is different from the re-generated cyclic redundancy check parity.

13. The degradation compensator of claim 11, wherein the cyclic redundancy check parity includes first through third cyclic redundancy check parity bits, wherein the cyclic redundancy checker includes first and second exclusive OR gates, and first through third D flip-flops, wherein a first input terminal of the first exclusive OR gate receives the partial data signal, a second input terminal of the first exclusive OR gate receives the third cyclic redundancy check parity bit, and an output terminal of the first exclusive OR gate outputs a first signal, wherein a data input terminal of the first D flip-flop receives the first signal, a clock input terminal of the first D flip-flop receives a clock signal, and a data output terminal of the first D flip-flop outputs the first cyclic redundancy check parity bit, wherein a first input terminal of the second exclusive OR gate receives the first signal, a second input terminal of the second exclusive OR gate receives the first cyclic redundancy check parity bit, and the output terminal of the second exclusive OR gate outputs a second signal, wherein a data input terminal of the second D flip-flop receives the second signal, a clock input terminal of the second D flip-flop receives the clock signal, and a data output terminal of the second D flip-flop outputs the second cyclic redundancy check parity bit, wherein a data input terminal of the third D flip-flop receives the second cyclic redundancy check parity bit, a clock input terminal of the third D flip-flop receives the clock signal, and a data output terminal of the third D flip-flop outputs the third cyclic redundancy check parity bit.

14. A degradation compensator comprising:

a compressor which generates a block-level compression stress matrix representing a degradation level of a block included in a frame by R, G, and B input signals of the block;

a non-volatile memory device;

an updater including a volatile memory, the updater which updates a frame-level accumulated compression stress matrix by adding the block-level compression stress matrix to the frame-level accumulated compression stress matrix when an enable signal is activated, the frame-level accumulated compression stress matrix stored in the volatile memory, the frame-level accumulated compression stress matrix representing an accumulated degradation level of the frame, the updater which outputs a portion of elements of a block-level accumulated compression stress matrix included in the frame-level accumulated compression stress matrix as a partial data signal sequentially when a power supply is stopped;

an error corrector which executes error-correction encoding to elements of the block-level accumulated compression stress matrix included in the frame-level accumulated compression stress matrix with different intensities and writes the encoded elements as a storage data of the non-volatile memory device when the power supply is stopped, the error corrector which executes error-correction decoding to the storage data and writes the decoded storage data as frame-level accumulated compression stress matrix of the volatile memory when the power supply is started;

a cyclic redundancy checker which generates a cyclic redundancy check parity by executing a cyclic redundancy check to the partial data signal and writes the cyclic redundancy check parity to the non-volatile memory device when the power supply is stopped;

a restorer which generates a block-level accumulated stress matrix by restoring a block-level accumulated compression stress matrix corresponding to the block among the frame-level accumulated compression stress matrix; and an internal compensator which generates compensated R, G, and B output signals corresponding to the block by adding the R, G, and B input signals and data compensation values generated based on the block-level accumulated stress matrix, wherein the updater reads the cyclic redundancy check parity from the non-volatile memory device when the power supply is started, and the updater activates or deactivates the enable signal by comparing the read cyclic redundancy check parity and a cyclic redundancy check parity which is re-generated from the frame-level accumulated compression stress matrix of the volatile memory written by the error corrector.

15. The degradation compensator of claim 14, wherein the updater activates the enable signal when the read cyclic redundancy check parity is the same as the re-generated cyclic redundancy check parity, wherein the updater deactivates the enable signal when the read cyclic redundancy check parity is different from the re-generated cyclic redundancy check parity.

16. The degradation compensator of claim 14, wherein the error corrector stops the writing operation to the non-volatile memory device when differences between elements of a frame-level accumulated compression stress matrix, which is re-read from the non-volatile memory device, and elements of the updated frame-level accumulated compression stress matrix exceed a predetermined range when the power supply is stopped.

* * * * *